US010526152B2

(12) United States Patent
Terakado

(10) Patent No.: US 10,526,152 B2
(45) Date of Patent: Jan. 7, 2020

(54) PAPER SUPPLY APPARATUS

(71) Applicant: RISO KAGAKU CORPORATION, Tokyo (JP)

(72) Inventor: Ryo Terakado, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/981,307

(22) Filed: May 16, 2018

(65) Prior Publication Data

US 2019/0031460 A1 Jan. 31, 2019

(30) Foreign Application Priority Data

Jul. 28, 2017 (JP) ..... 2017-146088

(51) Int. Cl.
*B65H 9/00* (2006.01)
*B41J 11/00* (2006.01)
(Continued)

(52) U.S. Cl.
CPC ..... *B65H 9/006* (2013.01); *B41J 11/009* (2013.01); *B41J 13/0027* (2013.01); *B41J 13/03* (2013.01); *B41J 13/08* (2013.01); *B41J 13/26* (2013.01); *B65H 5/062* (2013.01); *B65H 5/068* (2013.01); *B65H 7/02* (2013.01); *B65H 7/06* (2013.01); *B65H 3/32* (2013.01); *B65H 2404/14* (2013.01); *B65H 2404/50* (2013.01); *B65H 2408/10* (2013.01); *B65H 2511/10* (2013.01); *B65H 2513/104* (2013.01); *B65H 2513/20* (2013.01); *B65H 2513/50* (2013.01);
(Continued)

(58) Field of Classification Search
CPC ..... B65H 9/004; B65H 9/006; B65H 9/008; B41J 13/0018; B41J 13/26; B41J 13/08; B41J 13/0027
See application file for complete search history.

(56) References Cited

U.S. PATENT DOCUMENTS 5,543,909 A * 8/1996 Quesnel ..... B65H 9/006 271/228
8,905,400 B2 * 12/2014 Umeno ..... B65H 7/06 271/227
(Continued)

FOREIGN PATENT DOCUMENTS

JP 2010-215389 9/2010

*Primary Examiner* — Jeremy R Severson
(74) *Attorney, Agent, or Firm* — Greeblum & Bernstein, P.L.C.

(57) ABSTRACT

A paper supply apparatus includes: a primary paper supply roller that feeds out and conveys a print medium from a paper tray on which the print medium is placed; resist rollers that a leading end of the print medium abuts to form a flexure in the print medium by temporarily ceasing conveyance, and rotate at a predetermined timing after this flexure is formed, to convey the print medium toward a conveyance mechanism; and a control unit that executes assist control that drives the primary paper supply roller during the time that the print medium is being conveyed by the resist rollers to assist conveyance of the print medium by the resist rollers. The control unit executes the assist control such that the flexure in the print medium remains at a point in time at which the leading end of the print medium reaches the conveyance mechanism.

5 Claims, 9 Drawing Sheets

(51) Int. Cl.

| | |
|---|---|
| ***B65H 7/06*** | (2006.01) |
| ***B65H 5/06*** | (2006.01) |
| ***B41J 13/03*** | (2006.01) |
| ***B65H 7/02*** | (2006.01) |
| ***B41J 13/08*** | (2006.01) |
| ***B41J 13/26*** | (2006.01) |
| ***B41J 13/00*** | (2006.01) |
| *B65H 3/32* | (2006.01) |

(52) U.S. Cl.
CPC .... *B65H 2553/82* (2013.01); *B65H 2601/521* (2013.01); *B65H 2601/524* (2013.01); *B65H 2701/1311* (2013.01); *B65H 2701/1313* (2013.01); *B65H 2801/15* (2013.01)

(56) References Cited

U.S. PATENT DOCUMENTS

| | | | | |
|---|---|---|---|---|
| 8,925,911 | B2 * | 1/2015 | Nozaki | B65H 3/0669 271/10.03 |
| 9,061,844 | B2 * | 6/2015 | Takahashi | B65H 7/00 |
| 9,108,811 | B1 * | 8/2015 | Walsh | B65H 5/062 |
| 2016/0289026 | A1 * | 10/2016 | Iesaki | B65H 7/02 |

* cited by examiner

PAPER SUPPLY APPARATUS

CROSS-REFERENCE TO RELATED APPLICATIONS

The present application claims priority under 35 U.S.C. § 119 to Japanese Patent Application No. 2017-146088, filed on Jul. 28, 2017. The above application is hereby expressly incorporated by reference, in its entirety, into the present application.

BACKGROUND OF THE INVENTION

1. Field of the Invention

The present invention is related to a paper supply apparatus that feeds a print medium such as paper from a paper tray, and conveys the print medium to an image forming unit provided at a downstream side.

2. Description of the Related Art

Conventionally, inkjet printing apparatuses that convey a print medium such as paper and film, and administer printing by jetting ink onto the print medium from an ink head have been proposed.

In such inkjet printing apparatuses, paper supply intervals among print media which are sequentially conveyed from a paper tray are narrowed in order to improve productivity. A printing process that administers printing onto a print medium is conducted simultaneously with a paper supply operation of a next print medium.

For this reason, if vibrations which are generated in the paper supply operation of the next print medium is transferred to an image forming unit that includes the ink jet head, the landing positions of ink which is jetted from the ink head may shift, and there are cases in which errors such as blurring will be generated in a printed image.

Hereinafter, the factors that cause vibrations to be generated during the paper supply operation will be described. FIG. 8 is a schematic diagram for explaining the paper supply operation of a conventional inkjet printing apparatus.

In a conventional inkjet printing apparatus, first, a print medium P1 which is fed out from a paper tray is conveyed by being clamped between a paper supply roller 106, which is a primary paper supply roller, and a sorting plate 105. Then, the leading end of the print medium P1 which is conveyed by the paper supply roller 106 abuts resist rollers 108 and conveyance is temporarily ceased. Thereby, a flexure is formed in the print medium P1 at the position of the resist rollers 108. The resist rollers 108 rotate at a predetermined timing after this flexure is formed, and thereby the print medium P1 is conveyed toward a conveyor belt 202 provided at a downstream side at a desired timing, and is transferred to the conveyor belt 202. The conveyor belt 202 is an annular belt which is wound about rollers 204. The conveyor belt 202 conveys the print medium by suction or by electrostatic adsorption. Ink is jetted toward the print medium from ink heads 206 while the print medium is conveyed, to conduct printing. Note that the element denoted by P0 in FIG. 8 is a print medium which was supplied prior to the print medium P1. As described above, a printing operation onto the print medium P0 and paper supply of the next print medium P1 are conducted simultaneously.

Here, in conveyance control of the print medium as described above, control is exerted such that the conveyance speed of the resist rollers 108 is greater than the conveyance speed of the paper supply roller 106, and the print medium P1 is conveyed while the aforementioned flexure is gradually eliminated. However, because this operation is that in a state in which the resist rollers 108 pull the print medium P1, which is clamped between the paper supply roller 106 and the sorting plate 105, back tension will be generated in the print medium P1 at a point in time when the flexure is completely eliminated. As a result, vibrations and noise will be generated.

Japanese Unexamined Patent Publication No. 2010-215389 proposes a method for preventing such vibrations and noise from being generated. In this method, assist control, by which the degree of acceleration or the conveyance speed of a resist roller and a primary paper supply roller on an upstream side thereof is controlled while resist rollers convey a print medium, is executed in order to assist conveyance of the print medium by the resist rollers.

FIG. 9 is a diagram that illustrates a conventional example of the conveyance speeds of resist rollers and a primary paper supply roller when assist control is executed. In FIG. 9, (S) represents the conveyance speed of the resist rollers, and (Q) represents the conveyance speed of the primary paper supply roller during execution of assist control. In addition, in FIG. 9, (R) represents simulation results of an amount of flexure formed in a print medium at the position of the resist rollers in the case that the conveyance speeds of the primary paper supply roller and the resist rollers are controlled to be (S) and (Q).

In the conventional example illustrated in FIG. 9, assist control of the primary paper supply roller is initiated at a time t0, which is a predetermined amount of time after rotation of the resist rollers is initiated at a predetermined timing. Specifically, the primary paper supply roller initiates rotation at a predetermined degree of acceleration, and assists conveyance of the print medium at a conveyance speed represented by (Q) of FIG. 9.

Thereafter, the conveyance speed of the resist rollers is controlled to be a constant seed from a time t1 of FIG. 9, and deceleration of the primary supply roller is initiated from a time t2.

Then, at a time t3 illustrated in FIG. 9, rotation of the primary paper supply roller is ceased, that is, assist control is completed. Thereafter, deceleration of the resist rollers is initiated from a time t4, and the conveyance speed of the resist rollers is controlled to be a constant speed at a time t5. The constant speed at the time t5 and thereafter, is set in advance to be the same speed as the conveyance speed of a conveyor belt provided downstream, and the print medium is transferred from the resist rollers to the conveyor belt.

According to the conventional example illustrated in FIG. 9, back tension which is generated in the print medium between the primary paper supply roller and the resist rollers can be reduced. Thereby, the aforementioned vibrations and noise can be suppressed.

SUMMARY OF THE INVENTION

However, even if the conveyance speeds of the resist rollers and the primary paper supply roller are controlled as illustrated in FIG. 9, when the rotation of the primary paper supply roller is ceased, that is, at a point in time at which assist control is completed, in the case that the print medium is in a state nipped between the paper supply roller 106 and the sorting plate 105 and the flexure in the print medium is eliminated, back tension will be applied by the print medium against the rotation of the resist rollers 108, as indicated by the dotted arrow in FIG. 8.

As described above, the resist rollers 108 are controlled to be driven at the same conveyance speed as the conveyance speed of the conveyor belt 202. However, the conveyance speed of the resist rollers 108 will be a slower conveyance speed than that of the conveyor belt 202 in actuality due to the aforementioned back tension, as indicated by the dotted line in FIG. 9. For example, the conveyance speed of the resist rollers 108 will be decreased to approximately 400 mm/s with respect to the conveyance speed of the conveyor belt 202, which is 515 mm/s.

Thereby, the print medium will be pulled between the resist rollers 108 and the conveyor belt 202 at the point in time at which the print medium is transferred from the resist rollers 108 to the conveyor belt 202. As a result, vibrations will be generated, and there is a problem that errors will be generated in a printed image.

The present invention has been developed in view of the foregoing circumstances. It is an object of the present invention to provide a paper supply apparatus that executes assist control of a primary paper supply roller that prevents the generation of vibrations during paper supply operations of print media and suppresses errors in printed images.

A paper supply apparatus of the present invention comprises: a primary paper supply roller that feeds out and conveys a print medium from a paper tray on which the print medium is placed; resist rollers that a leading end of the print medium abuts to form a flexure in the print medium by temporarily ceasing conveyance, and rotate at a predetermined timing after this flexure is formed, to convey the print medium toward a conveyance mechanism provided at a downstream side; and a control unit configured to execute assist control that drives the primary paper supply roller during the time that the print medium is being conveyed by the resist rollers to assist conveyance of the print medium by the resist rollers; the control unit executing the assist control such that the flexure in the print medium remains at a point in time at which the leading end of the print medium reaches the conveyance mechanism.

According to the paper supply apparatus of the present invention, the control unit executes the assist control such that the flexure in the print medium remains at a point in time at which the leading end of the print medium reaches the conveyance mechanism in the paper supply apparatus that executes the assist control that drives a primary paper supply roller while the print medium is being conveyed by the resist rollers to assist the conveyance of the print medium by the resist rollers. Therefore, a reduction in the conveyance speed of the resist rollers due to back tension at a point in time at which the print medium is transferred from the resist rollers to the conveyance mechanism can be prevented. Accordingly, the generation of vibrations due to the print medium being pulled between the resist rollers and the conveyance mechanism can be prevented. As a result, errors in a printed image can be suppressed.

DETAILED DESCRIPTION OF THE EMBODIMENTS

Figure 1:
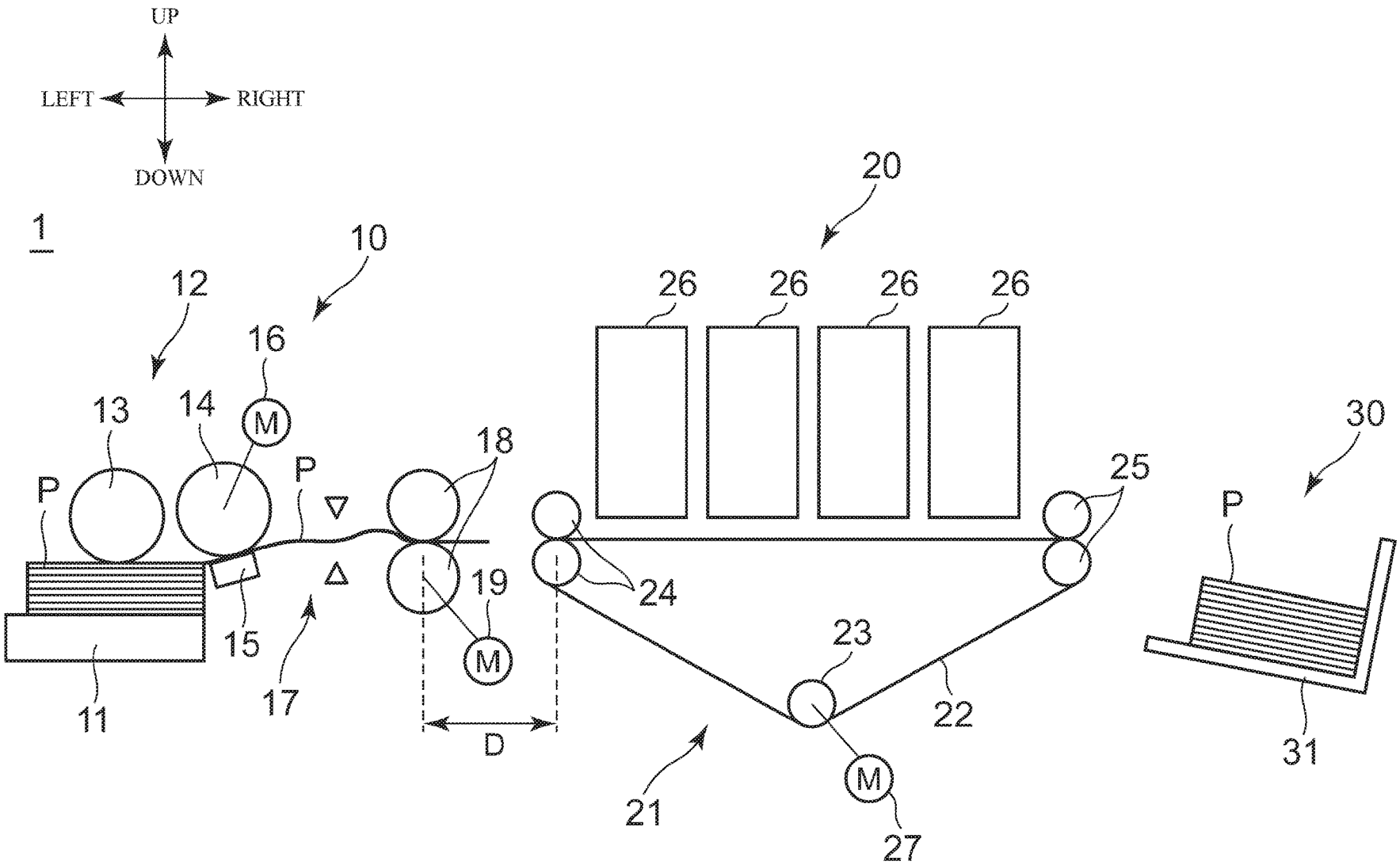
FIG. 1 is a schematic diagram that illustrates the configuration of an inkjet printing apparatus that employs an embodiment of a paper supply apparatus of the present invention.

Hereinafter, an inkjet printing apparatus that employs an embodiment of a paper supply apparatus of the present invention will be described in detail with reference to the attached drawings. The inkjet printing apparatus of the present embodiment has a characteristic feature in the control of conveyance of a print medium. However, the mechanical configuration of the inkjet printing apparatus as a whole will be described first. FIG. 1 is a schematic diagram that illustrates the configuration of the inkjet printing apparatus of the present embodiment. Note that the directions indicated as up, down, left, and right by the arrows in FIG. 1 are assumed to be the up, down, left, and right directions of the actual inkjet printing apparatus.

As illustrated in FIG. 1, the inkjet printing apparatus 1 of the present embodiment is equipped with a paper supply unit 10 (corresponding to the paper supply apparatus of the present invention), an image forming unit 20, and a paper discharge unit 30.

The paper supply unit 10 is equipped with: a paper tray 11, on which a print medium P such as paper and film is placed; primary paper supply rollers 12 configured to individually feed out an uppermost print medium P which is placed on the paper tray 11, convey the print medium P toward resist rollers 18 to be described later, and cause the print medium P to abut the resist rollers 18; a sheet end detector 17 configured to detect a leading end and a trailing end of the print medium P which is fed out by the primary paper supply rollers 12; and the resist rollers 18 configured to transfer the print medium P, which is fed out by the primary paper supply rollers 12, to the image forming unit 20, with a predetermined interval among sheets.

The primary paper supply rollers 12 of the present embodiment are equipped with: a pickup roller 13, a paper supply roller 14, and a sorting plate 15.

The pickup roller 13 contacts the uppermost print medium P which is placed on the paper tray 11 at a predetermined pressure, and moves the print medium P downstream by frictional force. The paper supply roller 14 is configured to clamp the print medium P between the paper supply roller 14 and the sorting plate 15. In the case that a plurality of sheets of the print medium P is supplied between the paper supply roller 14 and the sorting plate 15, the sorting plate 15 is fixed, and is formed by a material capable of obtaining a greater frictional force than the frictional force among the sheets of the print medium P. This configuration causes the sheets of the print medium P which are closer to the sorting plate 15 to lose conveyance power, and only the sheet of the print medium P close to the paper supply roller is conveyed downstream.

The pickup roller 13 and the paper supply roller 14 are driven by a first paper supply drive motor 16 to rotate in the counterclockwise direction in FIG. 1. Thereby, the print medium P which is fed out from the paper tray 11 is conveyed to the resist rollers 18. After the leading end of the print medium P abuts the resist rollers 18, the resist rollers 18 begins rotating at a predetermined timing to convey the print medium P. At this time, the pickup roller 13 and the paper supply roller 14 are continued to be driven at a predetermined rotational speed for a predetermined amount of time after conveyance of the print medium P by the resist rollers 18 is initiated. Thereby, conveyance of the print medium P by the resist rollers 18 is assisted. Note that assist control of the primary paper supply rollers 12 will be described in detail later.

The resist rollers 18 are constituted by a pair of conveying rollers that clamp (nip) the print medium P therebetween. The resist rollers 18 are driven by a second paper supply drive motor 19. The resist rollers 18 temporarily cease conveyance when the leading end of the print medium P which is conveyed by the primary paper supply rollers 12 abuts the resist rollers 18. Thereby, a flexure is formed in the print medium P. Rotation of the resist rollers 18 is initiated at a predetermined timing after the flexure is formed, and the print medium P is conveyed toward a sheet conveyance mechanism 21 to be described later, provided downstream from the resist rollers 18.

The sheet end detector 17 is provided at a position between the primary paper supply rollers 12 and the resist rollers 18, and detects the leading end and the trailing end of the print medium P which is conveyed from the primary paper supply rollers 12 toward the resist rollers 18. Conveyance of the print medium P by the primary paper supply rollers 12 and the resist rollers 18 is controlled based on detection signals which are output by the sheet end detector 17.

The image forming unit 20 is equipped with: four line heads 26; a sheet conveyance mechanism 21 (corresponding to the conveyance mechanism of the present invention). The line heads 26 jet ink onto the print medium P which is conveyed by the sheet conveyance mechanism 21 to administer printing. As illustrated n FIG. 1, the four line heads 26 are arranged along a conveyance path of the print medium P at predetermined intervals. The four line heads 26 respectively jet ink of a different color (black, cyan, magenta, and yellow, for example).

Each of the line heads 26 has two rows of heads, in which three head modules are arranged in a direction perpendicular to the conveyance direction of the print medium P at equidistant intervals, and is configured such that the two rows of heads are shifted by half a pitch in the aforementioned perpendicular direction. The head modules have a plurality of nozzles (not shown) which are arranged in the aforementioned perpendicular direction, and ink is jetted from the nozzles.

The sheet conveyance mechanism 21 is equipped with: a conveyor belt 22, a driving roller 23, driven rollers 24 and 25, a conveyance drive motor 27 for rotating the driving roller 23, etc. The sheet conveyance mechanism 21 conveys the print medium P, which is conveyed from the paper supply unit 10, beneath the line heads 26 in a suctioned or electrostatically adsorbed state while maintaining a constant speed. After printing is administered by the line heads 26 onto the print medium P, the sheet conveyance mechanism 21 conveys the printed print medium P to the paper discharge unit 30.

The conveyor belt 22 is an annular belt which is wound about the driving roller 23 and the driven rollers 24 and 25. The conveyor belt 22 is constituted by a material which is flexible and generates an appropriate amount of frictional force with the print medium P, such as rubber or a resin.

A plurality of suctioning apertures are formed in the conveyor belt 22. The conveyor belt 2 holds the print medium P on the upper surface thereof by a suctioning force which is generated at the suctioning apertures by a fan, which is not illustrated, being driven. The conveyor belt 22 conveys the print medium P, which is held by the suctioning force, to the rightward direction in FIG. 1, by rotating in the clockwise direction in FIG. 1.

The driven rollers 24 and 25 support the conveyor belt 22 along with the driving roller 23. The driven rollers 24 and 25 are driven by the driving roller 23 via the conveyor belt 22. The driven rollers 24 and the driven rollers 25 are provided along the conveyance direction such that they are arranged at the same height. The driving roller 23 is provided beneath the driven rollers 24 and 25.

The paper discharge unit 30 is equipped with a paper discharge tray 31, and sequentially stock sheets of the printed print medium P, onto which printing has been administered by the image forming unit 20.

Figure 2:
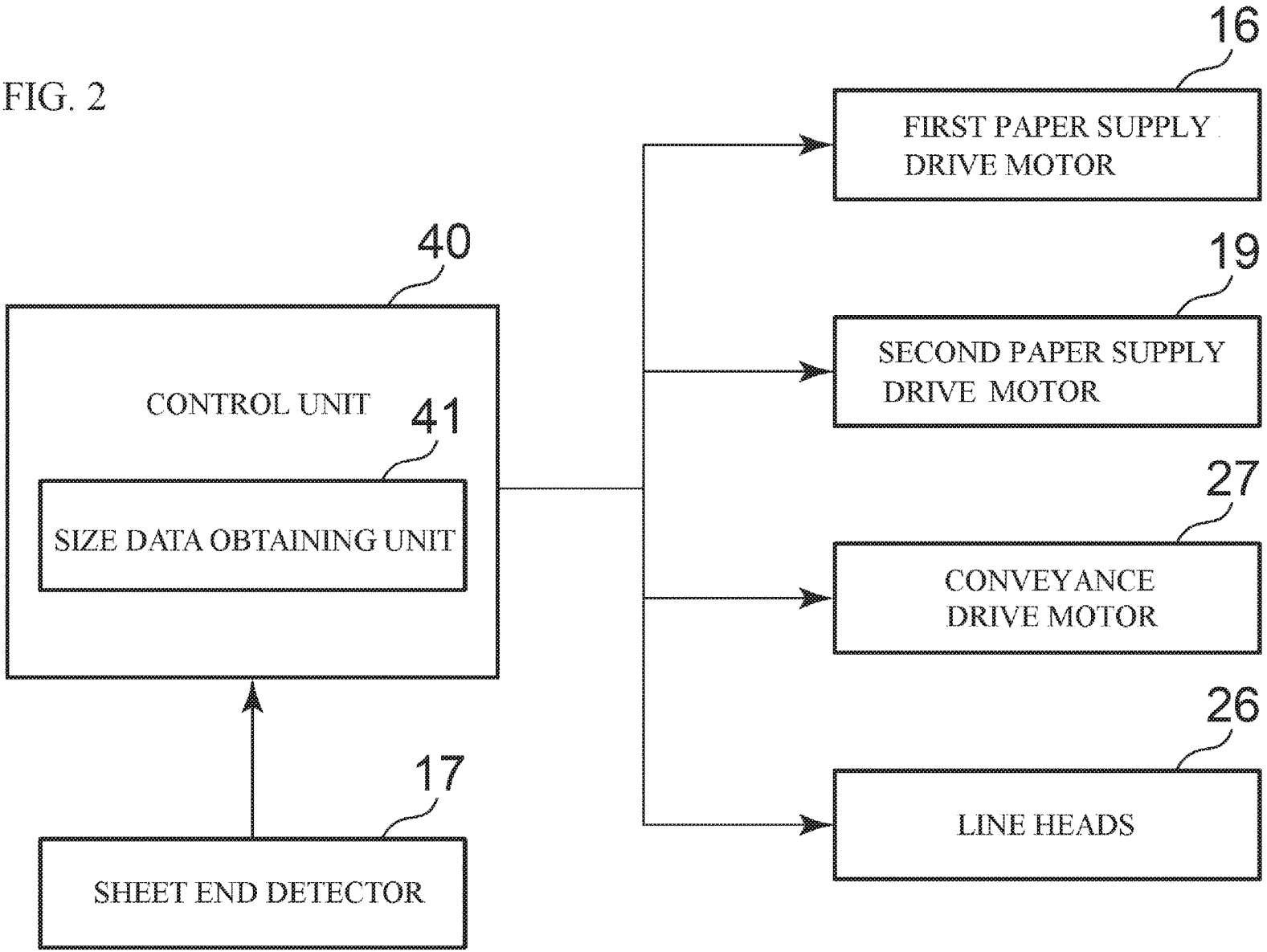
FIG. 2 is a schematic block diagram that illustrates the configuration of a control system of the inkjet printing apparatus illustrated in FIG. 1.

FIG. 2 is a schematic block diagram that illustrates the configuration of a control system of the inkjet printing apparatus 1 of the present embodiment. As illustrated in FIG. 2, the inkjet printing apparatus 1 of the present embodiment is equipped with a control unit 40 that controls the operation of each component of the inkjet printing apparatus 1.

The control unit 40 is equipped with a CPU (Central Processing Unit), a semiconductor memory, a hard disk, etc. The control unit 40 controls the first paper supply drive motor 16, the second paper supply drive motor 19, the conveyance drive motor 27, and the line heads 26, by executing programs which are recorded in storage medium such as the semiconductor memory or the hard disk, and by operating electric circuits. Thereby, the print medium P is conveyed, and ink is jetted from the line heads 26 onto the print medium P to administer printing.

Here, when the assist control of the primary paper supply rollers 12 is executed during conveyance of the print medium P by the resist rollers 18 as described above, in the case that a sheet of the print medium P remains between the paper supply roller 14 and the sorting plate 15 after the assist control is completed, the paper supply roller 14 is configured to rotate accompanying conveyance of the print medium P by frictional force with the print medium P.

However, back tension is applied by the print medium P against the rotation of the resist rollers 18, because the print medium P is in a nipped state between the paper supply roller 14 and the sorting plate 15. The resist rollers 18 are controlled to be driven such that the print medium P is transferred to the sheet conveyance mechanism 21 at the same conveyance speed as the conveyance speed of the sheet conveyance mechanism 21. However, the conveyance speed will be slower than that of the sheet conveyance mechanism 21 in actuality, due to the aforementioned back tension. Thereby, the print medium will be pulled between the resist rollers 18 and the sheet conveyance mechanism 21 at a point in time at which the print medium is transferred from the resist rollers 18 to the sheet conveyance mechanism 21. As a result, vibrations will be generated, and there is a problem that errors will be generated in a printed image by these vibrations being transferred to the image forming unit 20.

Therefore, the present embodiment executes the assist control such that the flexure in the print medium P at the position of the resist rollers 18 remains, at the point in time at which the leading end of the print medium P reaches the sheet conveyance mechanism 21, in order to reduce the vibrations caused by the decrease in the conveyance speed of the resist rollers 18 due to the aforementioned back tension. That is, the assist control is executed such that the flexure in the print medium P remains at a point in time that the resist rollers 18 convey the print medium P for the distance D illustrated in FIG. 1. By executing the assist control in this manner, the decrease in the conveyance speed of the resist rollers 18 due to the aforementioned back tension can be prevented, and can prevent the generation of vibrations caused thereby.

In addition, the control unit 40 is also equipped with a size data obtaining unit 41. The size data obtaining unit 41 obtains size data of the print medium P. The size data of the print medium P is data related to the length of the print medium P in the conveyance direction, and may be data representing a standard size such as A4, B4, and A3, or may be the length of the print medium P in the conveyance direction itself. The size data of the print medium P is input as a setting on a printing condition setting screen displayed by a printer driver, for example, and the size data which is input as a setting is obtained by the size data obtaining unit 41.

The size data of the print medium P obtained by the size data obtaining unit 41 is employed in the assist control of the paper supply rollers 12. Here, in the case that the assist control of the primary paper supply rollers 12 is executed as described above and flexure is eliminated at the position of the resist rollers 18 after the print medium P reaches the sheet conveyance mechanism 21, for example, if the print medium P remains between the paper supply roller 14 and the sorting plate 15, the print medium P which is nipped between the paper supply roller 14 and the sorting plate 15 will be pulled by the resist rollers 18. Thereby, periodic vibrations will be generated, and there is a problem that errors will be generated in printed images by these vibrations being transferred to the image forming unit 20.

Therefore, the present embodiment obtains the size data of the print medium P with the size data obtaining unit 41 as described above, and determines the completion timing of the assist control based on the size data. Specifically, the control unit 40 of the present embodiment employs the size data of the print medium P to execute the assist control until the trailing end of the print medium P passes through the paper supply roller 14 and the sorting plate 15, and completes the assist control at a point in time at which the trailing end of the print medium P passes through the paper supply roller 14 and the sorting plate 15 or at a point in time thereafter.

By controlling the completion timing of the assist control in this manner, the print medium P, which is nipped between the paper supply roller 14 and the sorting plate 15, can be prevented from being pulled between the nipped position and the resist rollers 18. Thereby, the generation of the aforementioned vibrations can be prevented.

Figure 3:
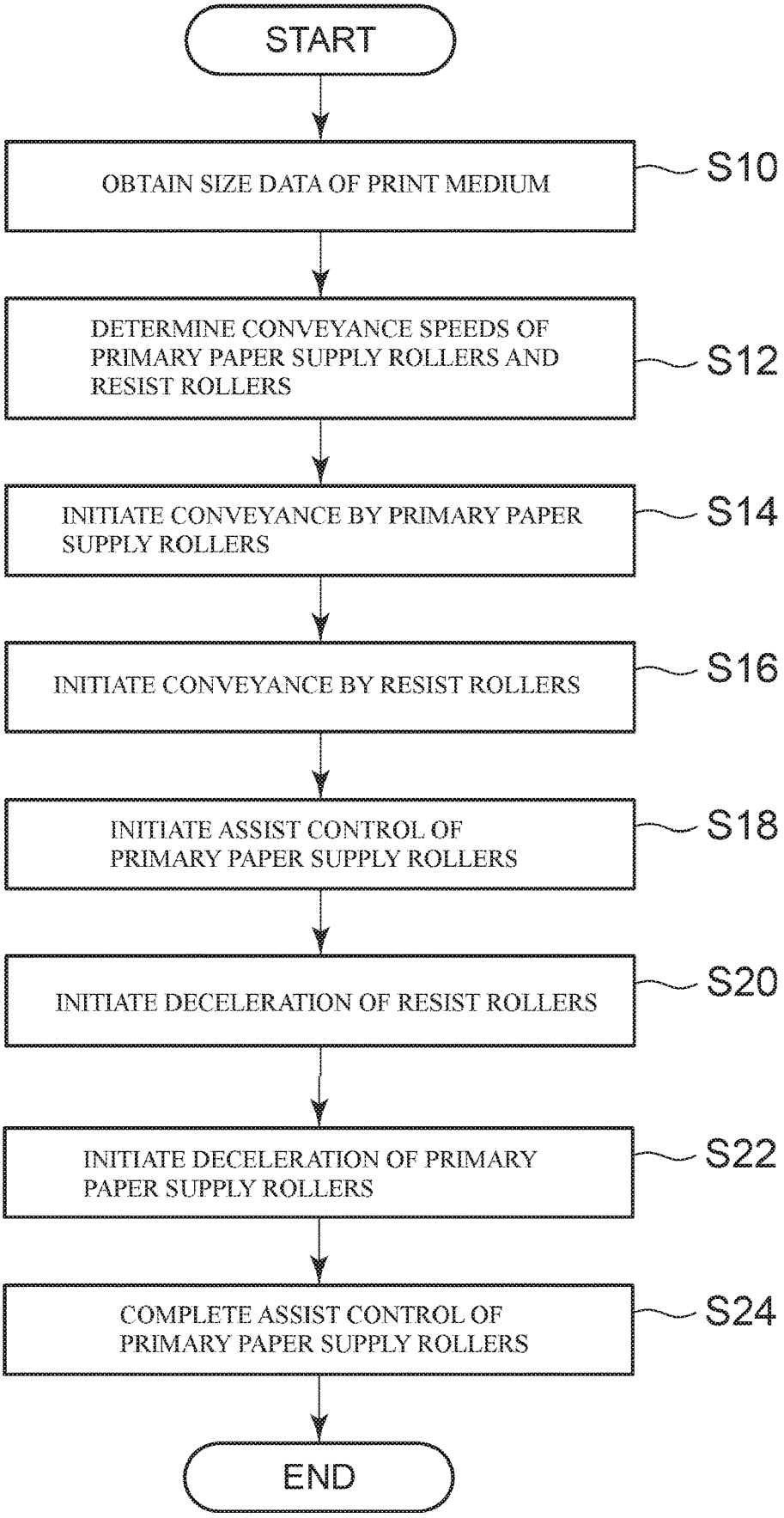
FIG. 3 is a flow chart for explaining the operation of the inkjet printing apparatus that employs the embodiment of the paper supply apparatus of the present invention.

Next, the operation of the inkjet printing apparatus 1 of the present embodiment will be described with reference to the flow chart illustrated in FIG. 3. Note that here, a description will be given mainly of conveyance control of the print medium P in the inkjet printing apparatus 1.

First, various printing conditions including the size data of the print medium P are input on a printing condition setting screen, and the size data of the print medium P which is input as a setting is obtained by the size data obtaining unit 41 (S10).

Figure 4:
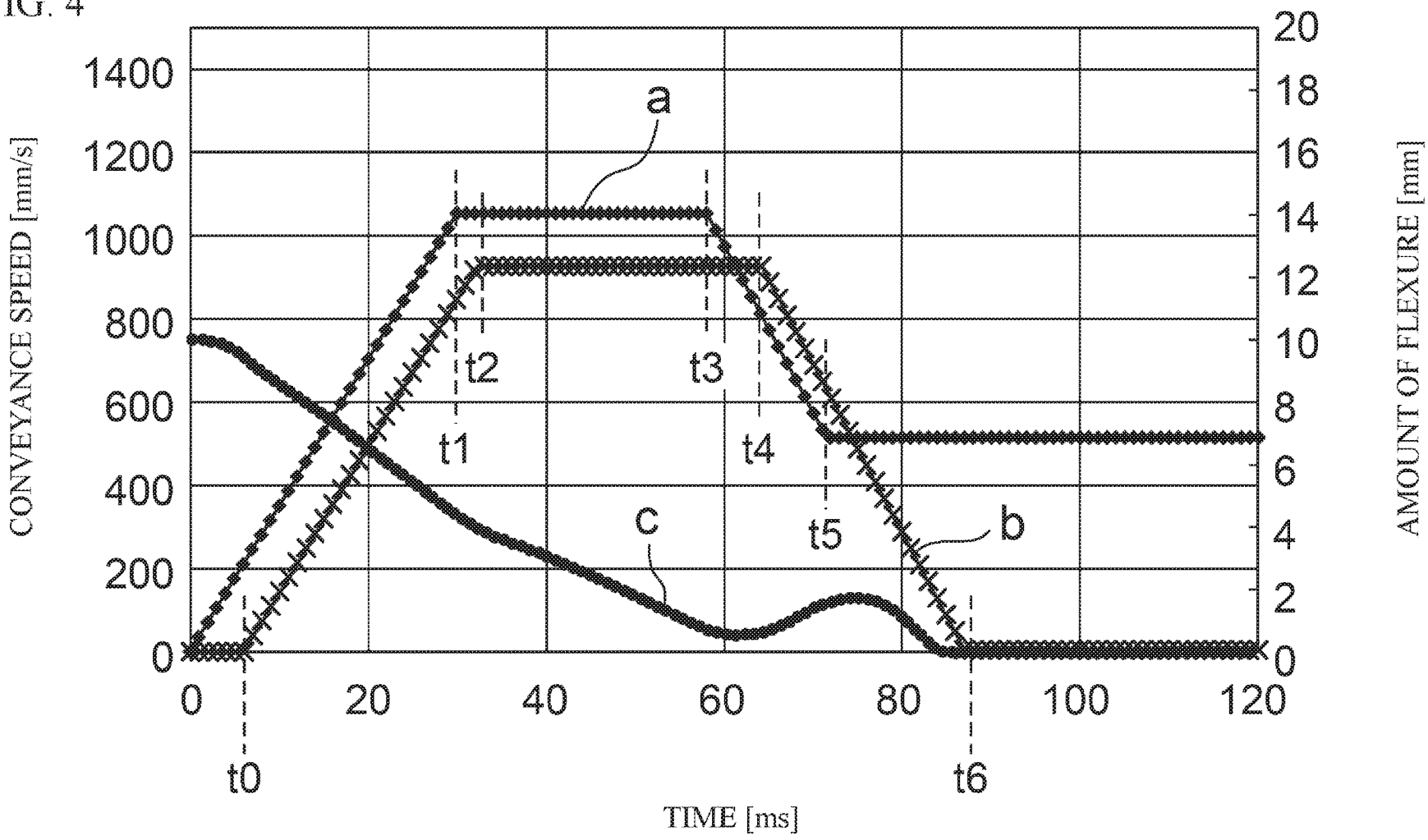
FIG. 4 is a diagram that illustrates an example of the conveyance speed of resist rollers and the conveyance speed of primary paper supply rollers during assist control.

Next, the control unit 40 determines the conveyance speeds of the primary paper supply rollers 12 and the resist rollers 18 based on the printing conditions which are input by a user as settings (S11). FIG. 4 is a diagram that illustrates the conveyance speed (a) of the resist rollers 18 and the conveyance speed (b) of the paper supply rollers 12 during assist control in the case of predetermined printing conditions. In FIG. 4, (c) represents simulation results of the amount of flexure formed in the print medium P at the position of the resist rollers 18 in the case that the conveyance speeds of the primary paper supply rollers 12 and the resist rollers 18 are controlled to be (a) and (b) illustrated in FIG. 4. Particularly, the control unit 40 of the present embodiment determines the conveyance speeds during the assist control such that the flexure in the print medium P at the position of the resist rollers 18 remains, at the point in time at which the leading end of the print medium P reaches the sheet conveyance mechanism 21, as described above. Further, the control unit 40 determines the completion timing (time t6) of the assist control based on the size data of the print medium P. Note that the completion timing (time t6) of the assist control will be a later timing as the length of the print medium P in the conveyance direction is longer, and will be an earlier timing as the length of the print medium P in the conveyance direction is shorter, Then, after the conveyance speeds of the primary paper supply rollers 12 and the resist rollers 18 are determined by the control unit 40, conveyance of the print medium P by the primary paper supply rollers 12 is initiated (S14). Specifically, the uppermost sheet of the print medium P is fed out by the pickup roller 13, and the print medium P is conveyed toward the resist rollers 18 by the paper supply roller 14. The conveyance speed of the primary paper supply rollers 12 is also determined in advance according to the size data of the print medium P, etc.

Next, conveyance by the primary paper supply rollers 12 is temporarily ceased at the point in time at which the leading end of the print medium P abuts the resist rollers 18 and a predetermined amount of flexure is formed.

Thereafter, rotation of the resist rollers 18 is initiated at a predetermined timing, and conveyance of the print medium P by the resist rollers 18 is initiated (S16). Specifically, the resist rollers 18 initiate rotation at a predetermined degree of acceleration, and convey the print medium P at a conveyance speed such as that illustrated in (a) of FIG. 4.

Next, assist control of the primary paper supply rollers 12 is initiated at the time t0, which is a timing at which a predetermined amount of time has elapsed after the point in time at which the conveyance by the resist rollers 18 is initiated (S18). Specifically, the primary paper supply rollers 12 reinitiate rotation at a predetermined degree of acceleration, to assist conveyance of the print medium P at a conveyance speed such as that illustrated in (b) of FIG. 4. Note that in the present embodiment, driving of the resist rollers 18 and the primary paper supply rollers 12 is controlled such that the degrees of acceleration of the resist rollers 18 and the primary paper supply rollers 12 are the same. However, the present invention is not limited to such a configuration.

Thereafter, the conveyance speed of the resist rollers 18 is controlled to be a constant speed from a time t1 illustrated in FIG. 4, and the conveyance speed of the primary paper supply rollers 12 is controlled to be a constant speed from the time t2. Note that at this time, the driving of the resist rollers 18 and the primary paper supply rollers 12 is controlled such that the conveyance of the resist rollers 18 is faster than the conveyance sped of the primary paper supply rollers 12.

Then, deceleration of the resist rollers 18 is initiated from a time t3 illustrated in FIG. 4 (S20), and deceleration of the primary paper supply rollers 12 is initiated at a time t4 following the time t3 (S22). In the present embodiment, control is executed such that the degree of deceleration of the resist rollers 18 and the degree of deceleration of the primary paper supply rollers 12 are the same. In addition, control is executed such that the conveyance speed of the primary paper supply rollers 12 is greater than the conveyance speed of the resist rollers 18. Thereby, the amount of flexure in the print medium P, which gradually decreases after conveyance by the resist rollers 18 is initiated, can be increased again, as indicated by (c) of FIG. 4. The present embodiment determines the conveyance speed and the deceleration timing of the resist rollers 18 as well as the conveyance speed and the deceleration timing of the primary paper supply rollers 12 such that the flexure which is formed again in the print medium P remains at a point in time that the leading end of the print medium P reaches the conveyor belt 22 (driven rollers 24) of the sheet conveyance mechanism 21, as described above.

Next, the conveyance speed of the resist rollers 18 is controlled to be a constant speed from a time t5 illustrated in FIG. 4. The constant speed at the time t5 and thereafter is set to be the same speed as the conveyance speed of the sheet conveyance mechanism 21, and the print medium P is transferred from the resist rollers 18 to the sheet conveyance mechanism 21.

In the present embodiment, the conveyance is controlled such that the flexure in the print medium P remains at a point in time that the leading end of the print medium P reaches the conveyor belt 22 (driven roller 24) of the sheet conveyance mechanism 21. Therefore, the decrease in the conveyance speed of the resist rollers 18 described above can be prevented, and the print medium P can be transferred to the sheet conveyance mechanism 21 in a state in which the conveyance speed of the resist rollers 18 is maintained. Accordingly, the generation of vibrations caused by the print medium P being pulled between the resist rollers 18 and the sheet conveyance mechanism 21 can be prevented. As a result, errors in printed images can be suppressed.

Figure 5:
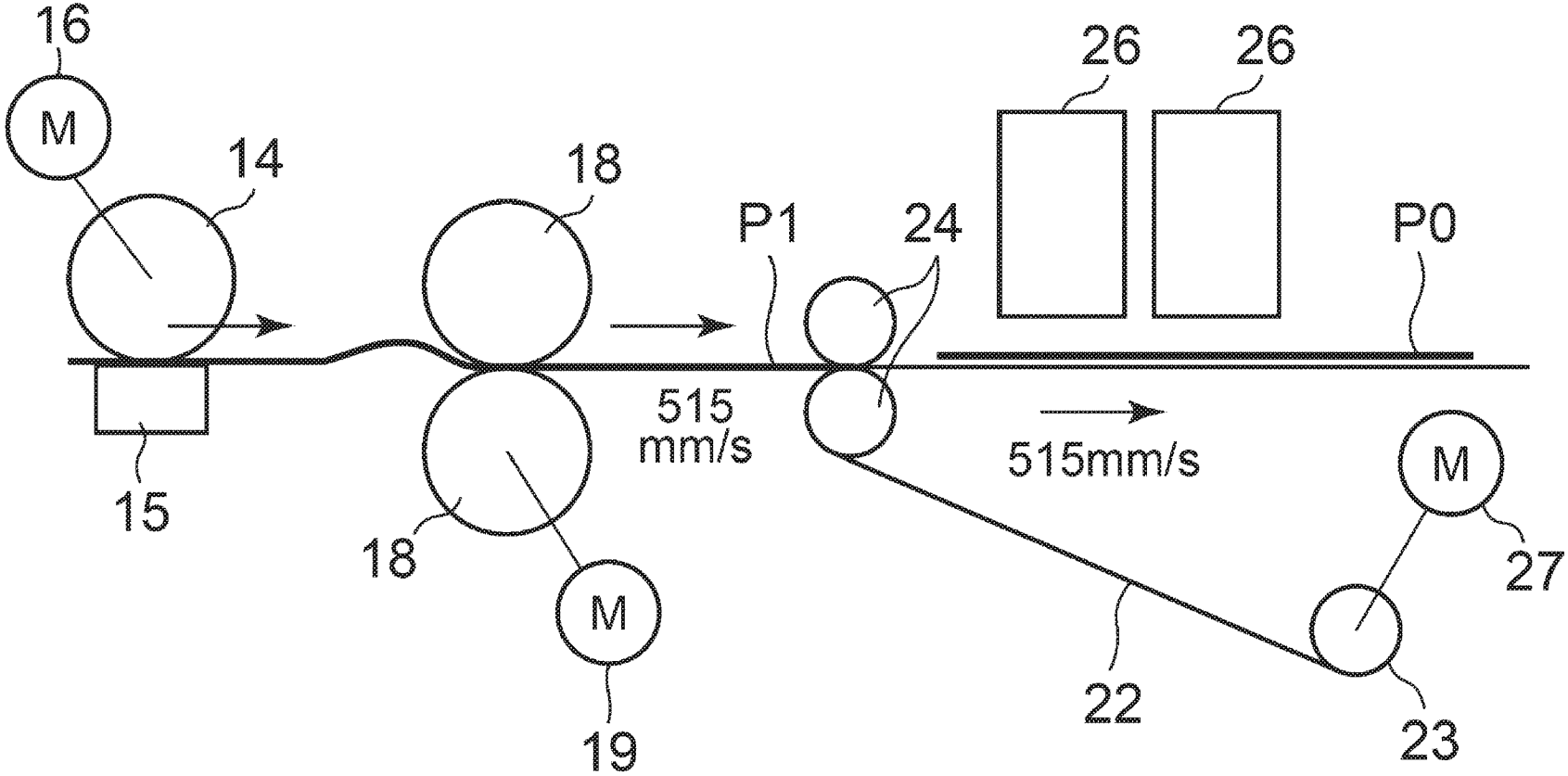
FIG. 5 is a schematic diagram that illustrates a state at a point in time at which a leading end of a print medium reaches a sheet conveying mechanism.

FIG. 5 is a schematic diagram that illustrates a state at the point in time at which the leading end of a print medium P1 reaches the sheet conveying mechanism 21. The flexure in the print medium P1 is maintained at the position of the resist rollers 18, and the resist rollers 18 is capable of transferring the print medium P1 at the same conveyance speed as the conveyance speed of the sheet conveyance mechanism 21, which is 515 mm/s. Note that a print medium P0 is a print medium which is conveyed prior to the print medium P1. Printing is administered onto the print medium P0 while the print medium P1 is being conveyed by the resist rollers 18.

After the leading end of the print medium P1 reaches the sheet conveyance mechanism 21, conveyance by the resist rollers 18 and the assist control of the primary paper supply rollers 12 is continued while the flexure in the print medium P1 is gradually eliminated. The assist control of the primary paper supply rollers 12 is completed at the time t6, which is the point in time at which the trailing end of the print medium P1 passes through the paper supply roller 14 and the sorting plate 15, or a point in time thereafter (S24). Conveyance of the print medium P1 by the resist rollers 18 is completed thereafter.

Note that in the embodiment described above, the conveyance speeds of the resist rollers 18 and the primary paper supply rollers 12 were controlled as illustrated in FIG. 4. However, the method of controlling the conveyance speeds is not limited to this example, and control may be executed to realize other patterns of conveyance speeds as long as the flexure in the print medium P remains at the point in time at which the leading end of the print medium P reaches the conveyor belt (driven roller 24) of the sheet conveyance mechanism 21.

Figure 6:
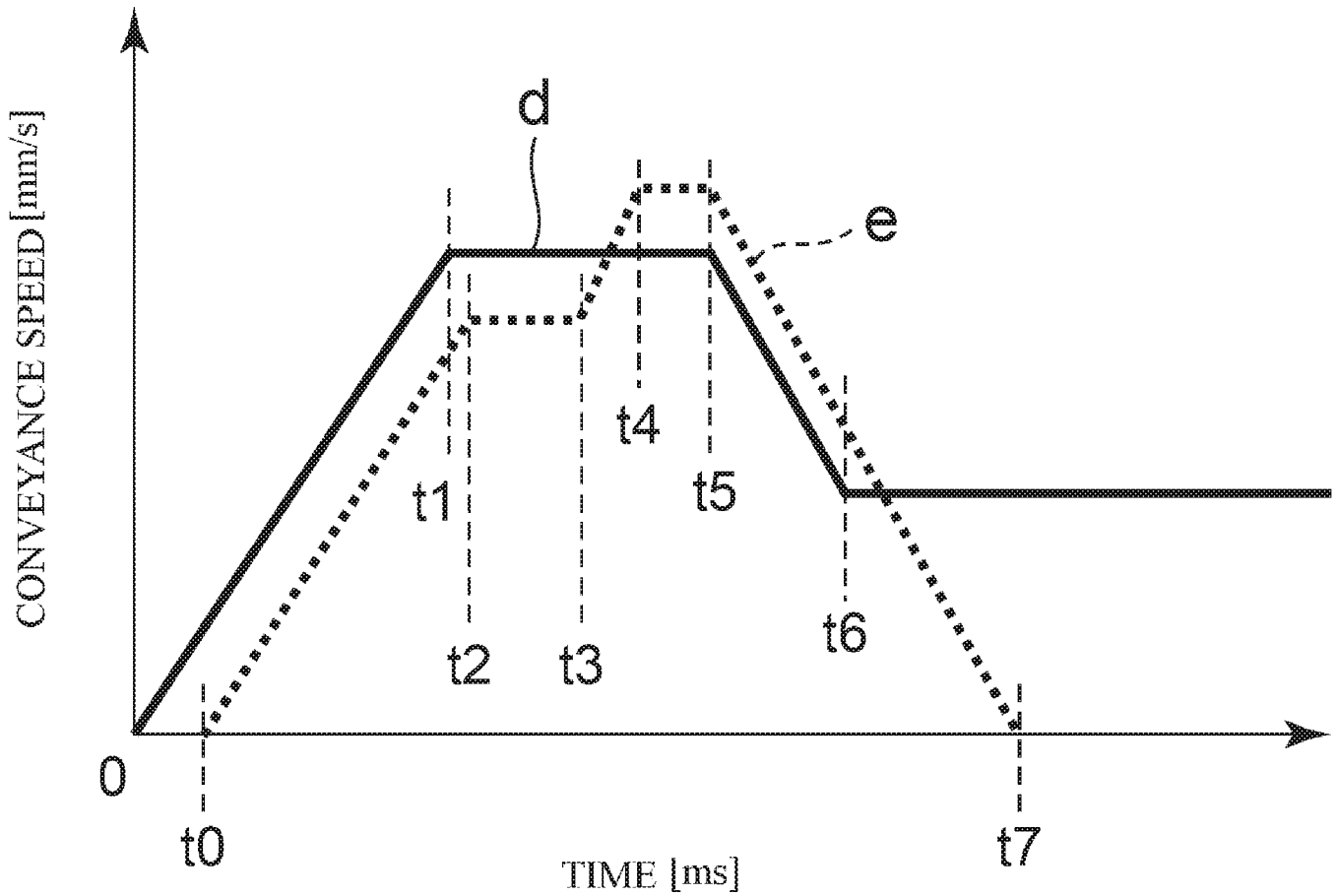
FIG. 6 is a diagram that illustrates another example of the conveyance speed of the resist rollers and the conveyance speed of the primary paper supply rollers during assist control.

Specifically, the deceleration of the primary paper supply rollers 12 is initiated after the deceleration of the resist rollers 18 is initiated to form the flexure in the print medium P again in the above embodiment, for example. However, it is not necessary for control to be executed in this manner. The timings at which deceleration of the resist rollers 18 and deceleration of the primary paper supply rollers are initiated may be the same, as illustrated in FIG. 6. In FIG. 6, (d) represents the conveyance speed of the resist rollers 18, and (e) represents the conveyance speed of the primary supply rollers 12.

In the example illustrated in FIG. 6, conveyance by the primary paper supply rollers 12 is initiated at a timing t0 after conveyance by the resist rollers 18 is initiated. Then, the conveyance speed of the resist rollers 18 is controlled to be a constant speed from a time t1, and the conveyance speed of the primary paper supply rollers 12 is controlled to be a constant speed from a time t2.

Next, the degree of acceleration of the primary paper supply rollers 12 is increased again from a time t3 to cause the conveyance speed of the primary paper supply rollers 12 to be greater than the conveyance speed of the resist rollers 18. After conveyance of a print medium at a constant speed from a time t4, deceleration of the resist rollers 18 and the primary paper supply rollers 12 is initiated at a time t5.

Then, the conveyance speed of the resist rollers 18 is controlled to be a constant speed from a time t6 illustrated in FIG. 6. The constant speed at and after the time t6 is set to be the same as the conveyance speed of the sheet conveyance mechanism 21, and a print medium P is transferred from the resist rollers 18 to the sheet conveyance mechanism 21.

After the leading end of the print medium P reaches the sheet conveyance mechanism 21, conveyance by the resist rollers 18 and the assist control of the primary paper supply rollers 12 is continued while the flexure in the print medium P1 is gradually eliminated. The assist control of the primary paper supply rollers 12 is completed at a time t7, which is the point in time at which the trailing end of the print medium P passes through the paper supply roller 14 and the sorting plate 15, or a point in time thereafter. Conveyance of the print medium P by the resist rollers 18 is completed thereafter.

In addition, in the inkjet printing apparatus 1 of the embodiment described above, the conveyance is controlled such that the flexure in the print medium P remains at a point in time that the leading end of the print medium P reaches the conveyor belt 22 (driven roller 24) of the sheet conveyance mechanism 21. Further, the completion timing of the assist control of the primary paper supply rollers 12 is determined based on the size data of the print medium P.

However, only the completion timing of the assist control may be controlled, without forming the flexure in the print medium P again.

Figure 7:
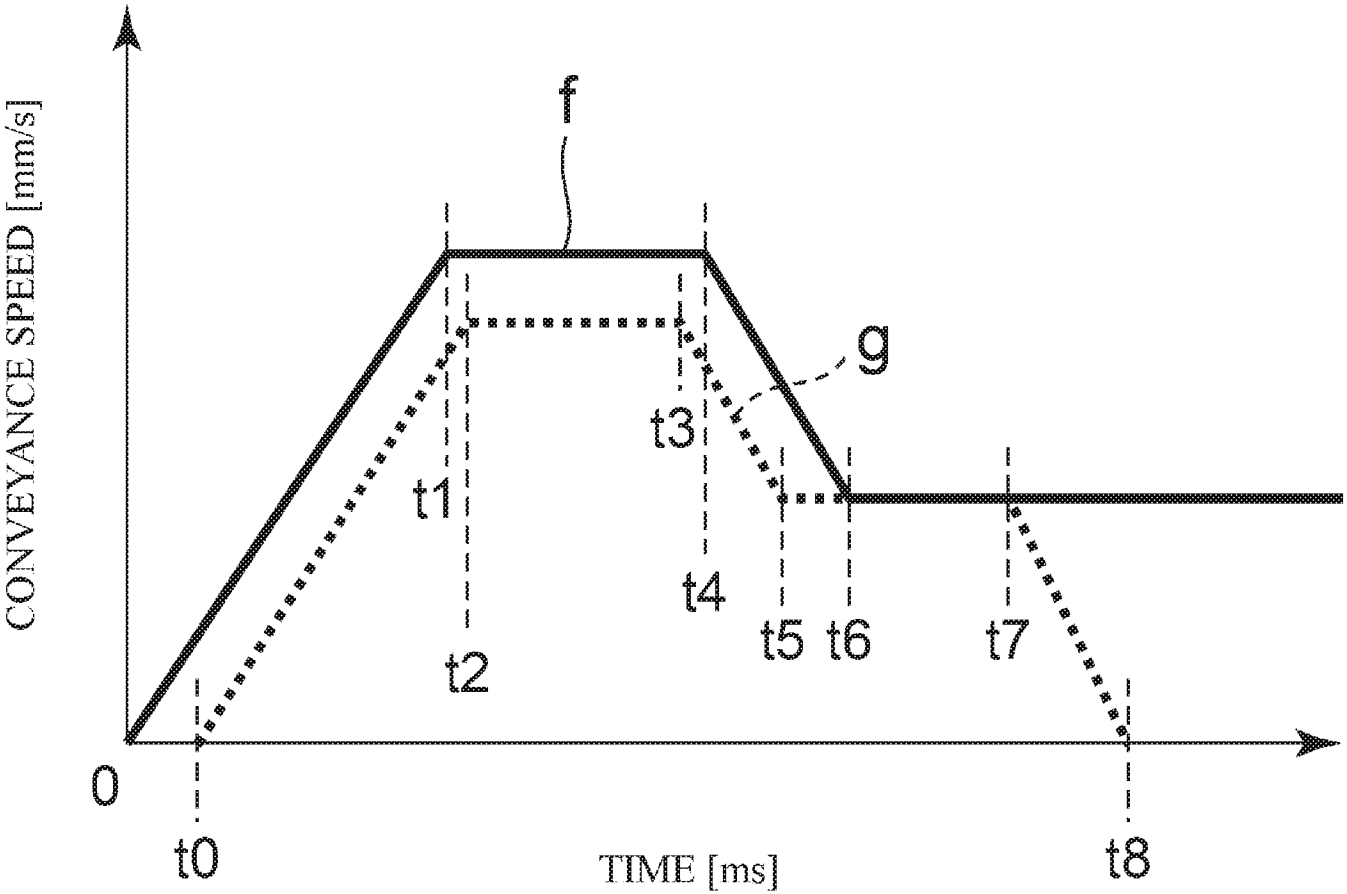
FIG. 7 is a diagram that illustrates still another example of the conveyance speed of the resist rollers and the conveyance speed of the primary paper supply rollers during assist control.
Figure 8:
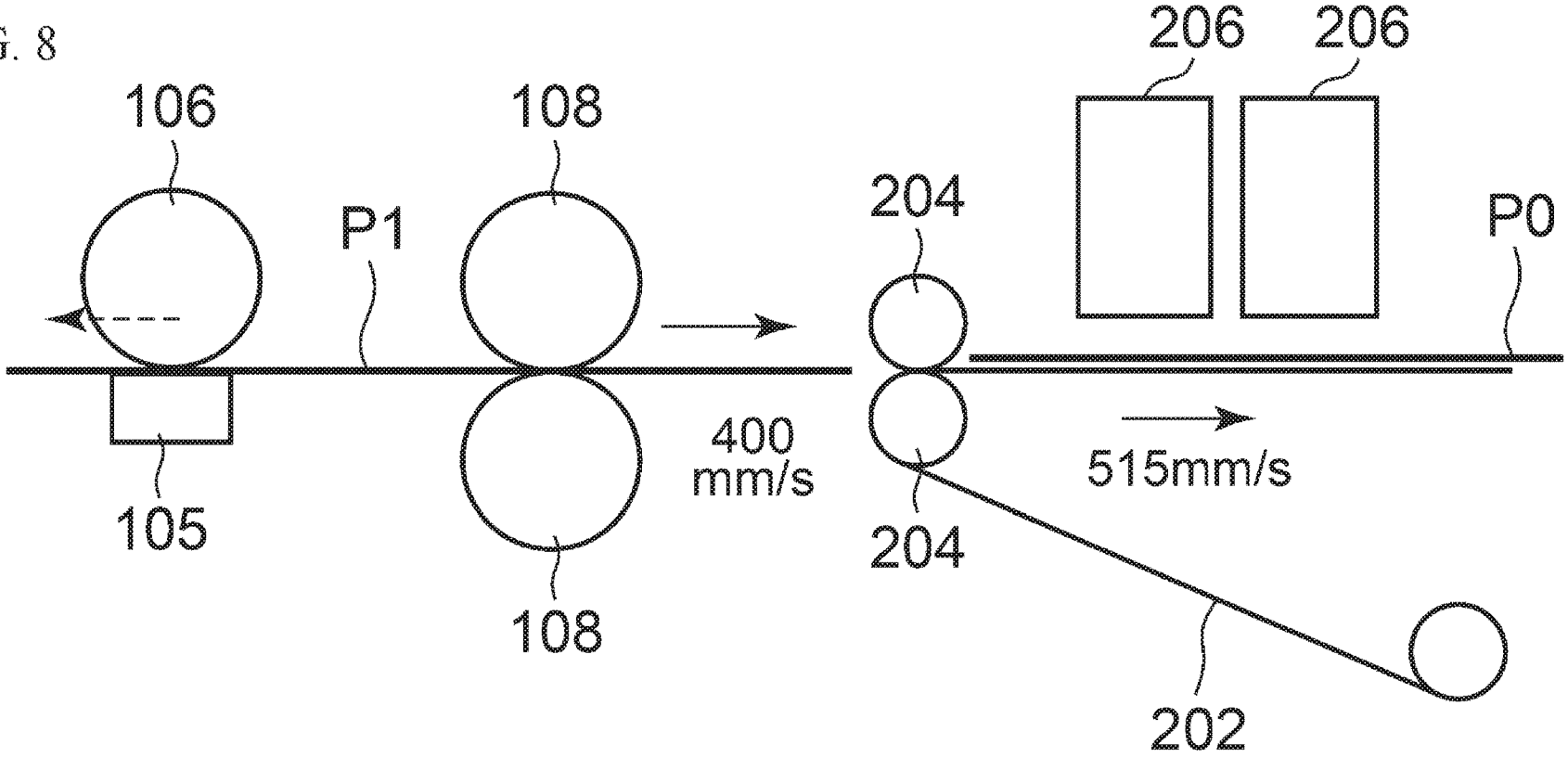
FIG. 8 is a schematic diagram for explaining a paper supply operation of a conventional inkjet printing apparatus.
Figure 9:
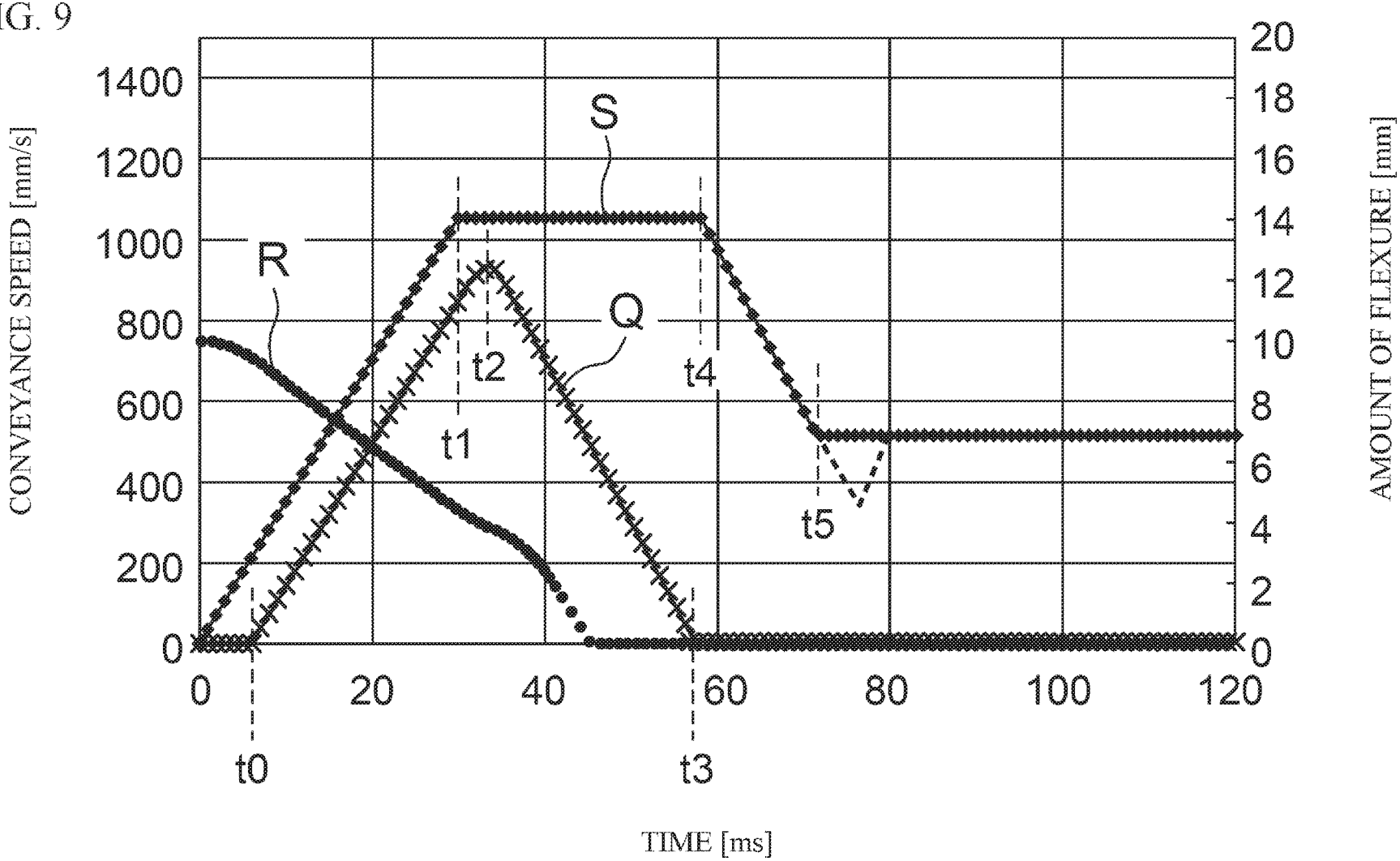
FIG. 9 is a diagram that illustrates a conventional example of the conveyance speed of resist rollers and the conveyance speed of a primary paper supply roller during assist control.

FIG. 7 is a diagram that illustrates an example of a case in which only the completion timing of assist control is controlled. In FIG. 7, (f) represents the conveyance speed of the resist rollers 18, and (g) represents the conveyance speed of the primary paper supply rollers 12.

In the example illustrated in FIG. 7, conveyance by the primary paper supply rollers 12 is initiated at a time t0 after conveyance by the resist rollers 18 is initiated. The conveyance speed of the resist rollers 18 is controlled to be a constant speed from a time t1, and the conveyance speed of the primary paper supply rollers 12 is controlled to be a constant speed from a time t2

Deceleration of the primary supply rollers 12 is initiated from a time t3 illustrated in FIG. 7, and deceleration of the resist rollers 18 is initiated at a time t4 thereafter. By controlling the timings at which deceleration is initiated in this manner, the flexure in a print medium P is gradually eliminated.

Then, the conveyance speed of the primary paper supply rollers 12 is controlled to be a constant speed from a time t5 illustrated in FIG. 7, and the conveyance speed of the resist rollers 18 is controlled to be a constant speed from a time t6 thereafter. The constant speed of the primary paper supply rollers 12 at and after the time t5 and the constant speed of the resist rollers 18 at and after the time t6 are set to be the same as the conveyance speed of the sheet conveyance mechanism 21, and the print medium P is transferred from the resist rollers 18 to the sheet conveyance mechanism 21.

After the leading end of the print medium P reaches the sheet conveyance mechanism 21, conveyance by the resist rollers 18 and the assist control of the primary paper supply rollers 12 is continued. The primary paper supply rollers 12 are controlled to decelerate again at a time t7. The assist control of the primary paper supply rollers 12 is completed at a time t8, which is the point in time at which the trailing end of the print medium P passes through the paper supply roller 14 and the sorting plate 15, or a point in time thereafter. Conveyance of the print medium P by the resist rollers 18 is completed thereafter.

The additional items below are also disclosed in relation with the inkjet printing apparatus of the present invention.

(Additional Items)

The paper supply apparatus of the present invention may be equipped with the size data obtaining unit configured to obtain the size data of the print medium. The control unit may determine the completion timing of the assist control based on the size data.

In the paper supply apparatus of the present invention, the control unit may execute assist control such that the conveyance speed of the print medium conveyed by the primary paper supply roller is greater than the conveyance speed of the print medium conveyed by the resist rollers.

In the paper supply apparatus of the present invention, the control unit may execute the assist control such that the deceleration of the conveyance speed of the print medium conveyed by the primary paper supply roller is initiated after the deceleration of the conveyance speed of the print medium conveyed by the resist rollers is initiated.

An alternate paper supply apparatus of the present invention comprises: a primary paper supply roller that feeds out and conveys a print medium from a paper tray on which the print medium is placed; resist rollers that a leading end of the print medium abuts to form a flexure in the print medium by temporarily ceasing conveyance, and rotate at a predetermined timing after this flexure is formed, to convey the print medium toward a conveyance mechanism provided at a downstream side; a control unit configured to execute assist control that drives the primary paper supply roller during the time that the print medium is being conveyed by the resist rollers to assist conveyance of the print medium by the resist rollers; and a size data obtaining unit configured to obtain size data of the print medium; the control unit determining a completion timing of the assist control based on the size data.

The alternate paper supply apparatus of the present invention obtains the size data of the print medium, and the completion timing of the assist control is determined based on the size data. Therefore, the assist control can be completed at a point in time at which the trailing end of the print medium passes the primary paper supply roller or at a point in time thereafter. Accordingly, the generation of vibrations caused by the print medium being pulled between the primary paper supply roller and the resist rollers can be prevented. As a result, errors in printed images can be suppressed.

What is claimed is:

1. A paper supply apparatus that feeds print media to a printing mechanism that administers printing on the print media, comprising:

a primary paper supply roller that feeds out and conveys a print medium from a paper tray on which the print medium is placed;

a movable conveyance mechanism having a conveyor belt that faces the printing mechanism downstream from the primary paper supply roller and a drive mechanism that drives the conveyor belt such that the print medium is conveyed at a constant speed;

resist rollers positioned downstream from the primary paper supply roller and upstream of the movable conveyance mechanism that a leading end of the print medium abuts to form a flexure in the print medium by temporarily ceasing conveyance, and rotate at a predetermined timing after this flexure is formed after correcting oblique movement of the print medium, to convey the print medium toward the movable conveyance mechanism; and a control unit configured to execute assist control that drives the primary paper supply roller during the time that the print medium is being conveyed by the resist rollers to assist conveyance of the print medium by the resist rollers, the control unit executing the assist control in a state in which the movable conveyance mechanism is capable of receiving and conveying the print medium at a predetermined conveyance speed to the printing mechanism, such that the flexure in the print medium remains at a point in time at which the leading end of the print medium reaches the movable conveyance mechanism.

2. A paper supply apparatus as defined in claim 1, further comprising:

a size data obtaining unit configured to obtain size data of the print medium; and wherein:

the control unit determines a completion timing of the assist control based on the size data.

3. A paper supply apparatus as defined in claim 1, wherein:

the control unit executes assist control such that the conveyance speed of the print medium conveyed by the primary paper supply roller is greater than the conveyance speed of the print medium conveyed by the resist rollers.

4. A paper supply apparatus as defined in claim 1, wherein:

the resist rollers convey the print medium at a conveyance speed and initiate deceleration of the conveyance speed of the print medium, the primary paper supply roller initiates deceleration the conveyance speed of the print medium after the resist rollers initiate deceleration of the print medium, and the control unit executes the assist control such that the deceleration of the conveyance speed of the print medium conveyed by the primary paper supply roller is initiated after the deceleration of the conveyance speed of the print medium conveyed by the resist rollers is initiated.

5. A paper supply apparatus, comprising:

a primary paper supply roller that feeds out and conveys a print medium from a paper tray on which the print medium is placed;

resist rollers that a leading end of the print medium abuts to form a flexure in the print medium by temporarily ceasing conveyance, and rotate at a predetermined timing after this flexure is formed, to convey the print medium toward a conveyance mechanism provided at a downstream side;

a control unit configured to execute assist control that drives the primary paper supply roller during the time that the print medium is being conveyed by the resist rollers to assist conveyance of the print medium by the resist rollers; and a size data obtaining unit configured to obtain size data of the print medium, the control unit continuing the assist control until the trailing end of the print medium passes the primary paper supply roller, and completing the assist control at a point in time at which the print media has passed the primary paper supply roller or at a point in time thereafter, based on the size data.

* * * * *